US006823534B2

(12) United States Patent
Li

(10) Patent No.: US 6,823,534 B2
(45) Date of Patent: Nov. 30, 2004

(54) DUAL FLUSH APPARATUS

(76) Inventor: Feiyu Li, First Floor, #43, Huli Main Road, Xiamen (CN), 361006

( * ) Notice: Subject to any disclaimer, the term of this patent is extended or adjusted under 35 U.S.C. 154(b) by 0 days.

(21) Appl. No.: 10/409,812

(22) Filed: Apr. 8, 2003

(65) Prior Publication Data

US 2004/0199988 A1 Oct. 14, 2004

(51) Int. Cl.[7] ..... E03D 3/12
(52) U.S. Cl. ..... 4/325; 4/407
(58) Field of Search ..... 4/407, 324–325

(56) References Cited

U.S. PATENT DOCUMENTS

| | | | | | |
|---|---|---|---|---|---|
| 3,320,622 | A | * | 5/1967 | Wustner | 4/325 |
| 3,879,765 | A | | 4/1975 | Moon | |
| 4,056,856 | A | | 11/1977 | Reid et al. | |
| 4,135,263 | A | | 1/1979 | Anderson | |
| 4,175,296 | A | * | 11/1979 | Goldman | 4/325 |
| 4,433,445 | A | | 2/1984 | Morris et al. | |
| 4,878,256 | A | | 11/1989 | Bagwell | |
| 4,937,894 | A | | 7/1990 | Hill, Jr. et al. | |
| 4,945,580 | A | * | 8/1990 | Schmitt et al. | 4/325 |
| 5,206,960 | A | | 5/1993 | Hooshley et al. | |
| 5,459,885 | A | | 10/1995 | Gaw | |
| 5,511,253 | A | | 4/1996 | Zamudio-Castillo et al. | |
| 5,673,440 | A | | 10/1997 | Carmona | |
| 5,697,122 | A | | 12/1997 | Okabe et al. | |
| 6,393,624 | B1 | | 5/2002 | Iwashita | |
| 6,510,866 | B2 | | 1/2003 | Li | |

* cited by examiner

*Primary Examiner*—Charles E. Phillips
(74) *Attorney, Agent, or Firm*—Walter A. Hackler

(57) ABSTRACT

A dual flush toilet and dual flush apparatus for a toilet having a discharge port for flushing water into a toilet bowl includes a buoyant flush valve for releasably sealing a discharge port and having a cavity for trapping air to cause a flush valve to remain open after unsealing of the flush valve from the discharge port. The flush valve has a weight for causing seating of the flush valve on the discharge port after flush the water through the discharge port. A control mechanism monitor the water tank is provided for controlling buoyancy of the flush valve by releasing entrapped air to effect either a full flush or partial flush of water from the water tank through the toilet bowl.

12 Claims, 7 Drawing Sheets

30
140
102
88
34
86
96
94
120
42
26
24
130
142
16

DUAL FLUSH APPARATUS

The present invention generally relates to toilet flush tank mechanisms and more particularly to apparatus including a buoyant flush valve and a control mechanism for controlling buoyancy of the flush valve.

Typical flush tank toilets are designed to use a standard of volume of water to flush a toilet bowl.

In view of the need for water conservation, dual flush toilets have been designed which allow the user the choice of effecting a full flush to disposed of solid wastes or a partial flush to dispose of liquid wastes.

Heretofore, designed dual flushing toilets have been designed which include multiple outlet ports, separate floats and multiple flushing handles.

The disadvantages of the prior art in addition to the utilization of multiple flushing ports and multiple exterior flushing handles includes unreliable mechanisms for use on a consistent basis which may be hard to operate, or costly, and require constant maintenance. Other devices require entry into the water tank for adjustment, which is not conducive to consumer use.

A present invention is directed to a dual flush toilet and further to dual flush toilet apparatus which converts an ordinary one flush tank toilet into a dual flushing toilet and further overcomes the disadvantages of the prior art.

SUMMARY OF THE INVENTION

Dual flush apparatus in accordance with the present invention for toilet having a water tank and a discharge port for flushing water into a toilet bowl generally includes a buoyant flush valve for releasably sealing a discharge port. The flush valve includes a cavity for entrapping air to cause the flush valve to remain open after unseating of the flush valve from the discharge port. The flush valve has a weight for causing seating of the flush valve on the discharge port after flushing of water through the discharge port.

A control mechanism is provided and configured for mounting to the water tank with the control mechanism including a handle and a lever which provides a means for interconnecting a handle and the flush valve for unseating the flush valve from the discharge port.

An air valve connected to the handle is pneumatically connected to the flush valve and vents entrapped air in the flush valve cavity at a selected water level within the water tank.

Thus, the control mechanism in accordance with the present invention controls the buoyancy of the flush valve by releasing entrapped air.

More particularly, the apparatus in accordance with the present invention includes a linkage which provides a means for enabling the handle to move the lever in a direction for unseating the flush valve as the handle is pivoted in either of a clockwise direction or a counterclockwise direction. As hereinafter described in greater detail, the directional pivoting of the handle enables either a full flush or a partial flush of water in the tank.

Still more particularly, the air valve in accordance with the present invention includes a body with an inlet and an outlet and a rotor disposed within the body and connected to the handle for pneumatically connecting the inlet and outlet as the handle is pivoted in one of the clockwise and counterclockwise directions and preventing a pneumatic connection between the inlet and the outlet as the handle is pivoted in another of the clockwise and counterclockwise directions. The pneumatic connection is provided by a flexible tube between the inlet and the flush valve, thus when the inlet and outlet are pneumatically connected the control mechanism controls the buoyancy of the flush valve.

In addition, the apparatus in accordance with the present invention includes a depending tube connected to the outlet with the depending tube having a length shorter than a depth of the water tank for enabling air escape from the outlet as the water level in the water tank falls below the selected level. The selected level is determined by a length of the depending tube.

Thus, when the handle is turned (or pivoted) in one of the clockwise or counterclockwise directions establishing a pneumatic connection between the inlet and the outlet and the water level falls below an end of the depending tube, air from the flush valve cavity is vented, thus reducing its buoyancy and causing early closure thereof onto the discharge port. This effects a partial flush. When the handle is turned (or pivoted) in an opposite direction no pneumatic connection is established between the inlet and the outlet, the buoyancy of the flush valve is not vented through the air valve and a full flush of water from the tank through the discharge port occurs.

When the apparatus of the present invention is incorporated to a toilet the invention includes a toilet bowl, a water tank with a discharge port for flushing water into the water bowl and a water valve, including a float, for filling the water tank to a full flushing level.

BRIEF DESCRIPTION OF THE DRAWINGS

The present invention will be more clearly understood with reference to the following detailed description in conjunction with the appended drawings, of which.

DETAILED DESCRIPTION

Figure 1:
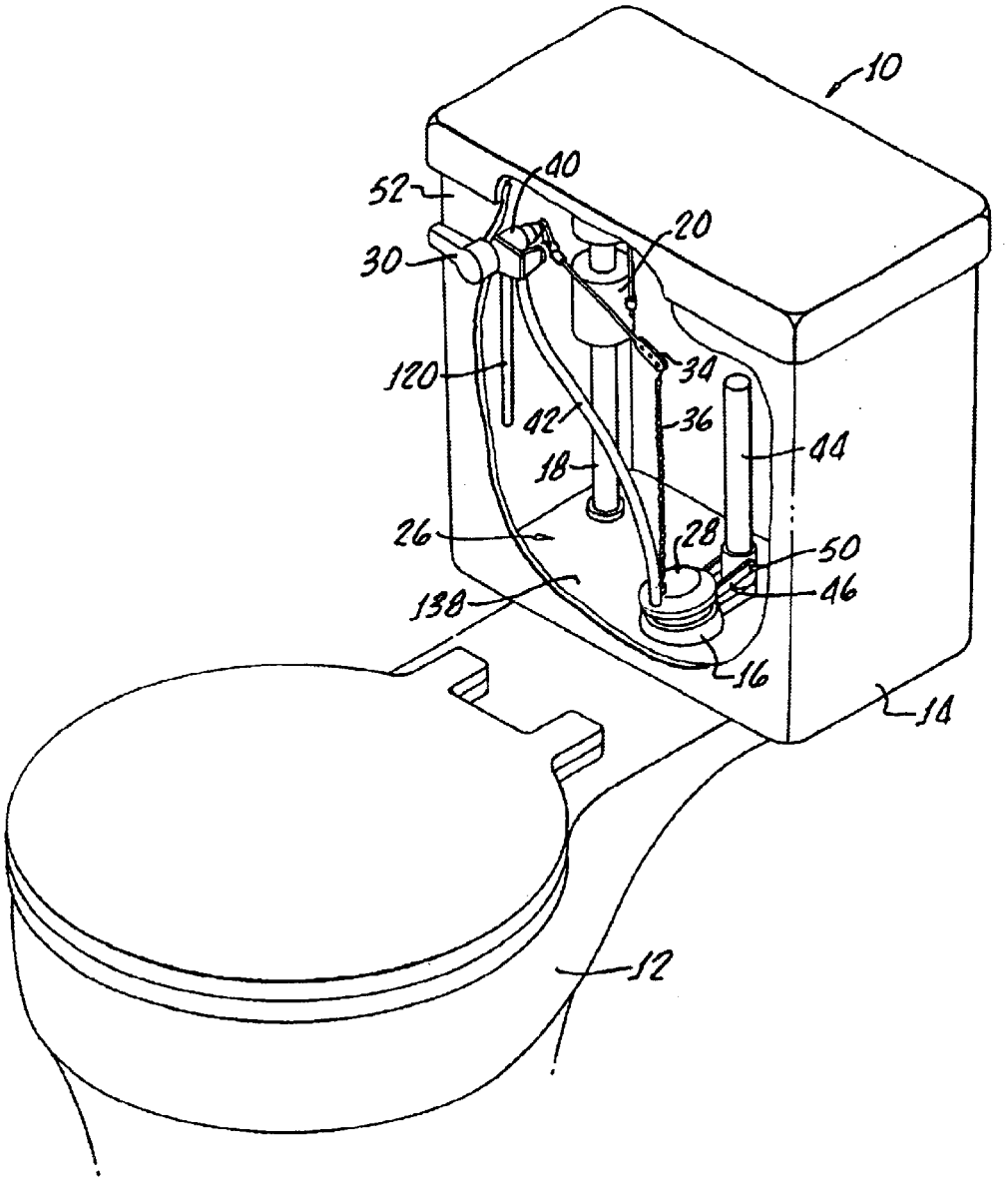
FIG. 1 is a perspective view of a toilet in accordance with the present invention partially broken away to show a control mechanism which generally includes a handle, a lever interconnecting the handle and a flush valve, along with an air valve connected to the handle and pneumatically connected to the flush valve. The pneumatic connection provides for venting of entrapped air in the flush valve as will be hereinafter described in greater detail.

With reference to FIG. 1 there is shown a dual flush toilet 10 in accordance with the present invention generally including a toilet bowl 12, a tank 14, a discharge port 16 for flushing water into the toilet bowl 12 and a water valve assembly 18 including a float 20 for filling the water tank 14 to a full flush level, not shown in FIG. 1.

Dual flush apparatus 26 in accordance with the present invention includes a buoyant flush valve 28, a handle 30, and a lever 34, interconnecting the handle 30 and the flush valve 28 through a chain 36, provides a means for unseating the flush valve 28 from the discharge port 16.

As more clearly shown in FIGS. 2–4, an air valve 40 is connected to the handle 30 and pneumatically connected to the flush valve 28 via a tube 42 for venting entrapped air in the flush valve 28 at a selected water level within the water tank 14, as hereinafter described in greater detail.

Figure 5:
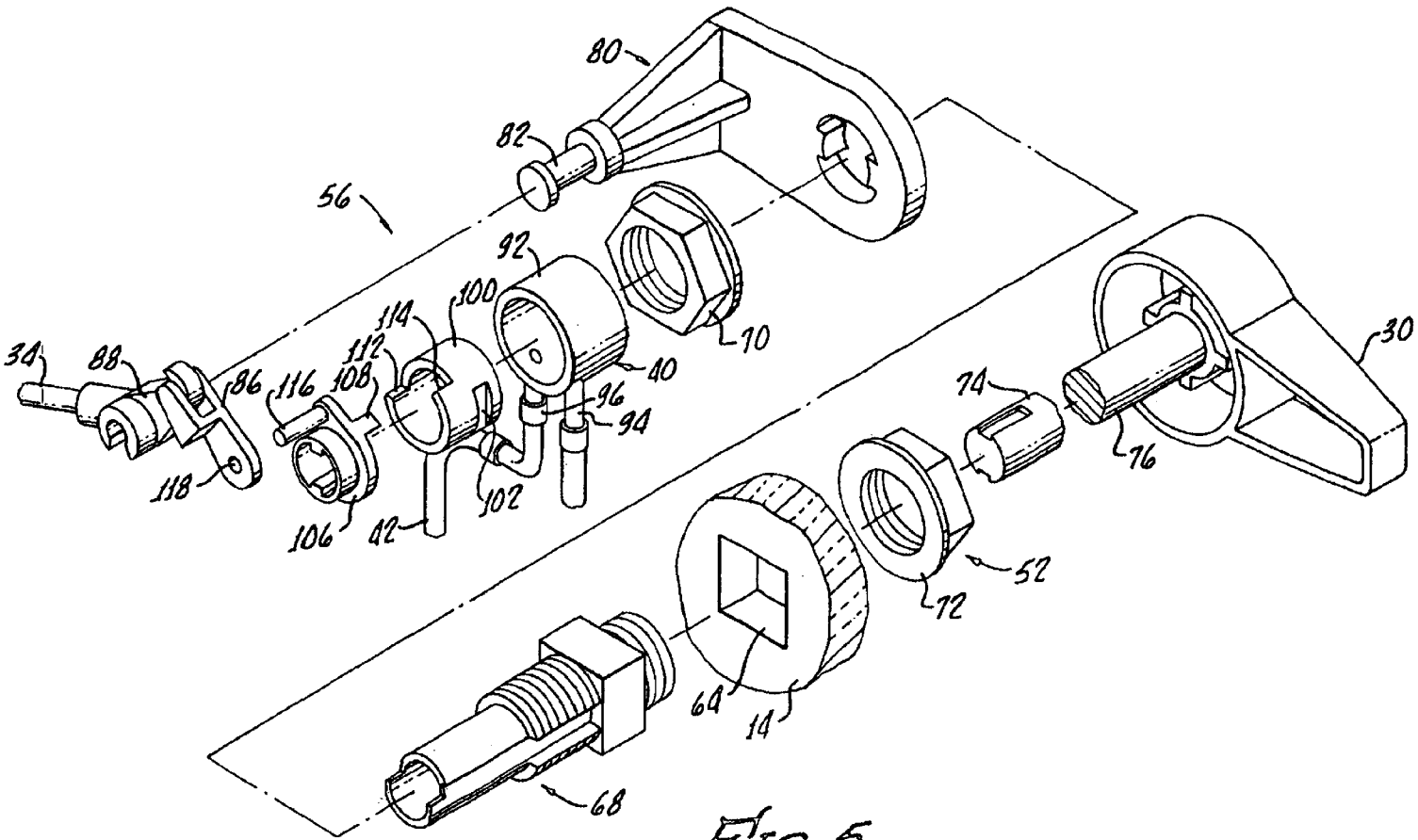
FIG. 5 is an exploded view of the handle and an air valve for venting entrapped air in the flush valve cavity at a selected water level within the water tank.

The lever 34 and chain 36 may be of conventional construction and the air valve 40 may be connected to a stand pipe 44 by arms 46 pivotally engaging pins 50. This pivoted arrangement enables seating and unseating of the flush valve 40 from the discharge port 16. The handle 30, lever 74 and air valve 40 are part of a control mechanism 52 which further includes, as shown in an exploded view in FIG. 5, a linkage 56 which provides a means for enabling the handle 30 to move the lever 34 in a direction for unseating a flush valve 26 as a handle 30 is pivoted in either of a clockwise direction as indicated by the arrow 60 or a counterclockwise direction as indicated by the arrow 62, see FIGS. 6–8.

With reference again to FIG. 5, the control mechanism 52 is configured for mounting to the water tank 14 through a hole 64 by a way of a stud 68, nuts 70, 72, pin 74 and handle shaft 76. No disassembly of the linkage 56 or air valve 40 is necessary for this mounting procedure.

Figure 6:
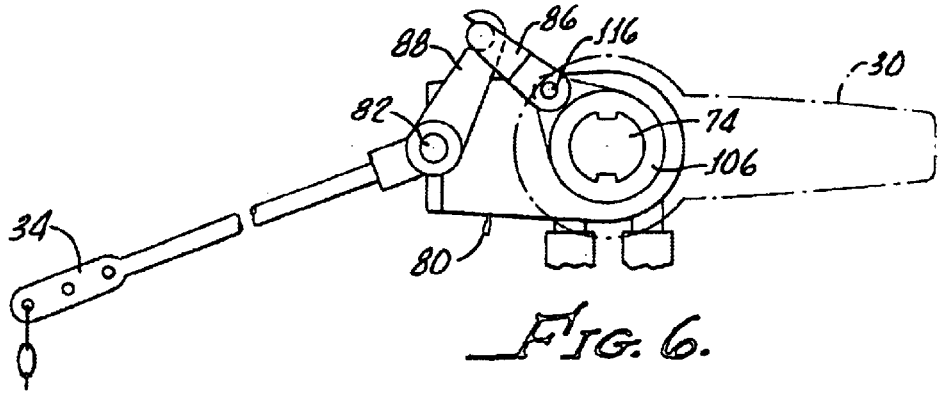
FIG. 6-8 shows operation of linkage for operation of the lever and air valve.
Figure 7:
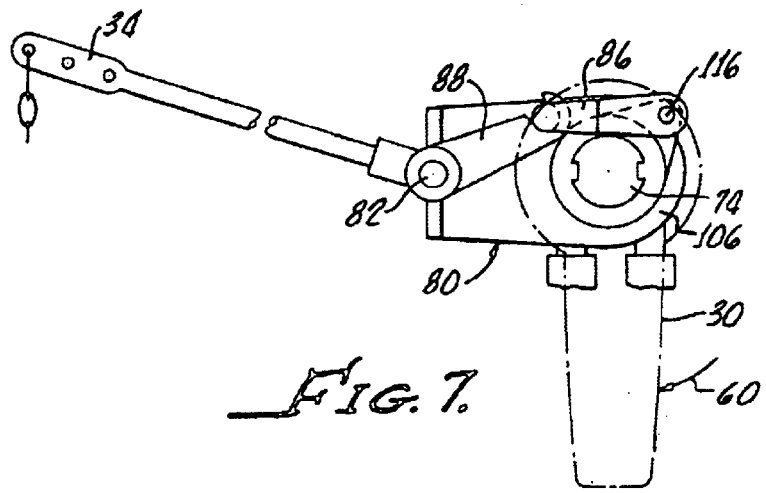
Figure 8:
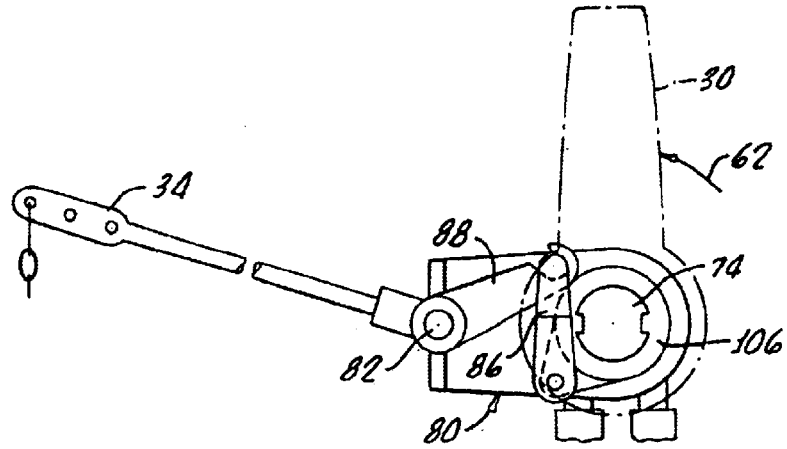
Figure 9:
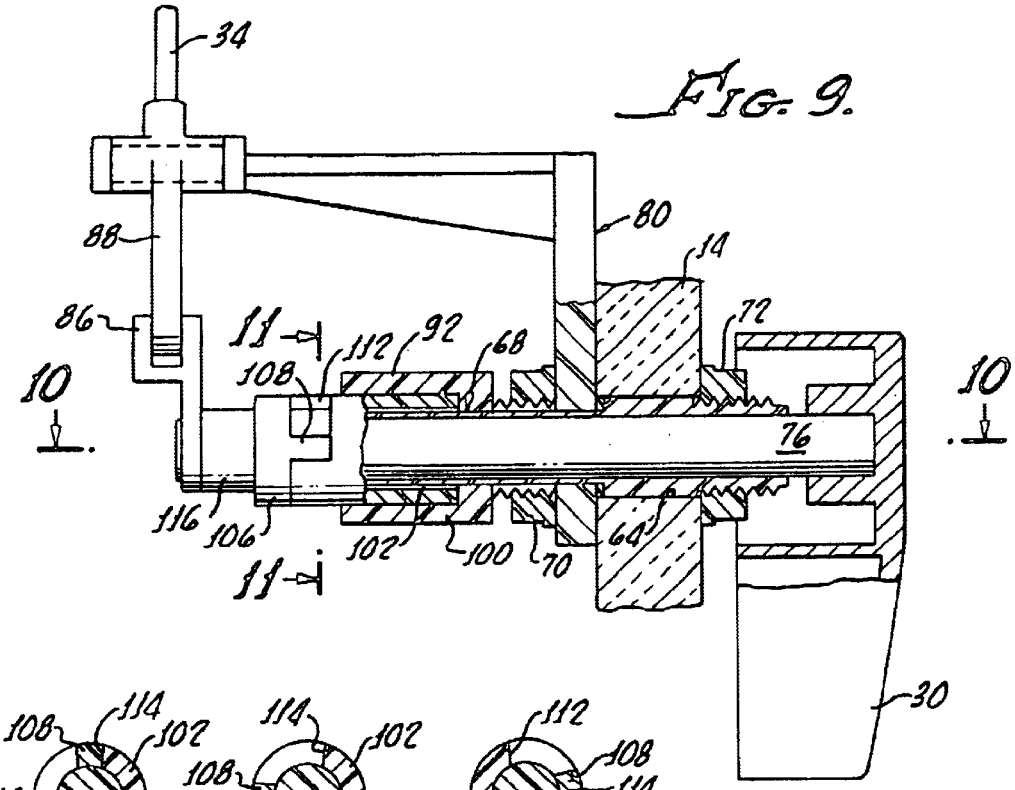
FIG. 9 shows the handle and air valve as assembled.
Figure 11:
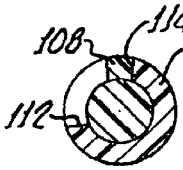
FIGS. 11, 12 and 13 are cross sectional views taken as indicated by the arrows in FIG. 9 across a rotor driver for positioning the rotor within the air valve body to control air flow therethrough.
Figure 12:
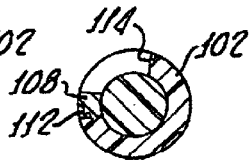
Figure 13:
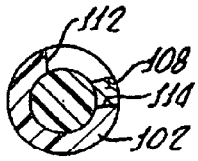
Figure 10:
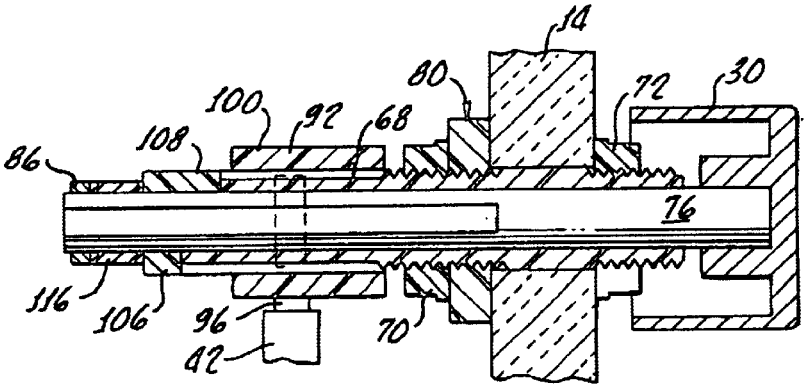
FIG. 10 is a cross sectional view taken along the line 10—10 of FIG. 9 illustrating a slot in a rotor of the air valve for controlling air flow between an inlet and outlet of an air valve body.

As shown in FIGS. 5–8, the linkage 56 includes an arm 80 and a pin 82 coupled to articulated members 86, 88. This articulated relationship enables a lifting of the lever from a downward position, as shown in FIG. 6 to raised positions as shown in FIGS. 7 and 8 with the pivoting of the handle 30 in either of a clockwise direction indicated by the arrow 60 or a counterclockwise direction as indicated by the arrow 62. Thus, rotation of the handle causes lifting and unseating of the flush valve 26 from the discharge port 60, as shown in FIGS. 3 and 4.

With reference again to FIG. 5, the air valve 40 includes a body 92 having an inlet 94 and an outlet 96 along with a rotor 100 disposed therein having a slot 102 for pneumatically connecting the inlet 92 and outlet 94 as a handle 30 is pivoted in one of the counterclockwise and clockwise directions and preventing pneumatic connection between the inlet 94 and outlet 96 as the handle 30 is pivoted in another of the counterclockwise and clockwise directions.

A rotor driver 106 is provided with a lug 106 for engagement of surfaces 112, 114 on the rotor to effect rotation of the rotor within the body 92 for either aligning the slot 102 over the inlet 92 and outlet 96 thus providing pneumatic connection or not aligning the slot 102 across the inlet 94 and outlet 96 thus preventing pneumatic connection.

The rotor driver 106 is in turn rotated through a pin 116 engaging a hole 118 in the articulated member 86. This connection is further illustrated in FIGS. 9 and 10 and FIGS. 11–13 illustrate the positioning of the slot 102 of the rotor 100 by movement of the lug 108 against the drive surfaces 112, 114.

As shown in FIGS. 1–4, the air valve body inlet 94 is connected to the flush valve 26 via the tube 42. The air valve body outlet 96 is connected to a depending tube 120 having a length shorter than a depth to the water tank for enabling escape of air from the outlet 94 from the flush valve 26 through the tube 42 as a water level in the water tank 14 falls below a selected level 124 the selected level being determined by a length of the depending tube, see FIG. 3.

Figure 2:
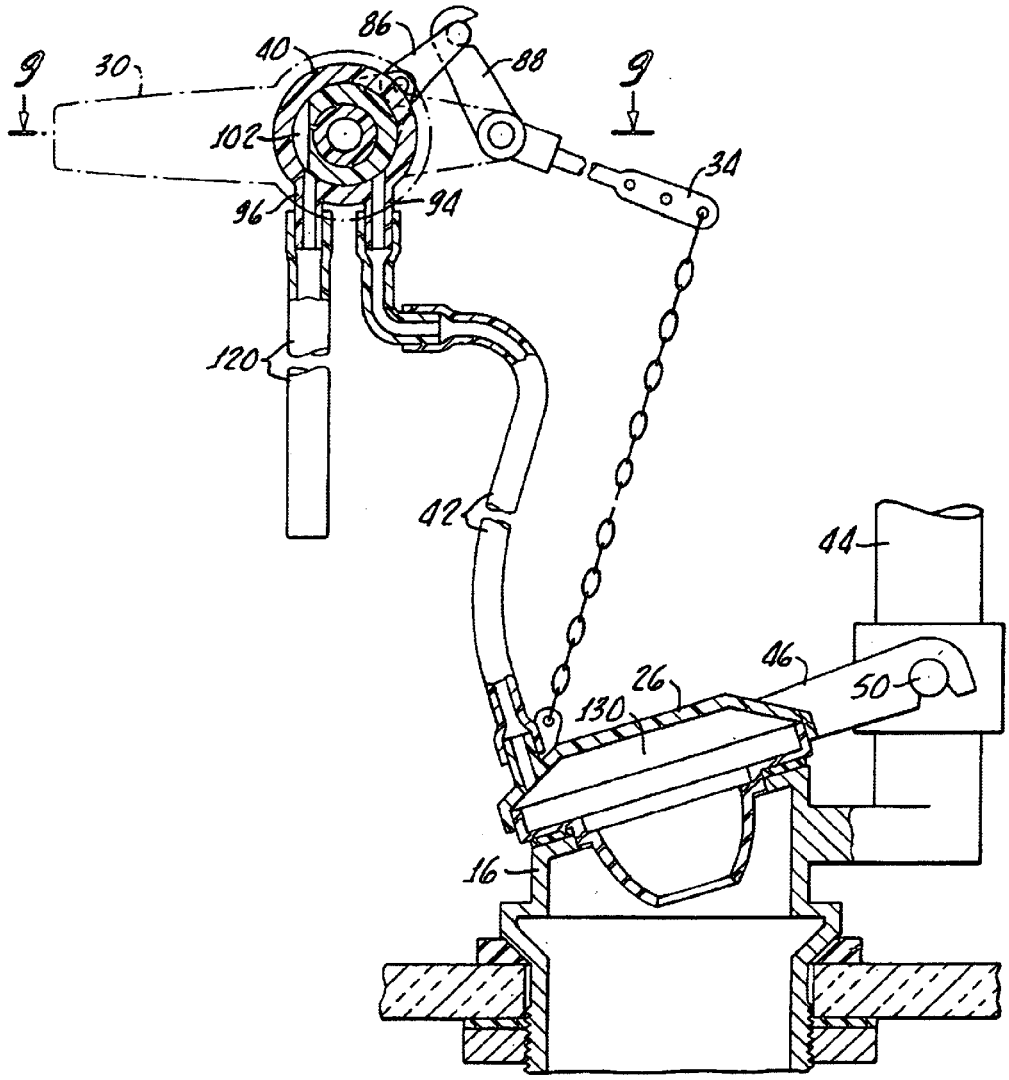
FIG. 2 is a side view of the control mechanism in accordance with the present invention partially broken away and showing the flush valve seated on a discharged port.
Figure 3:
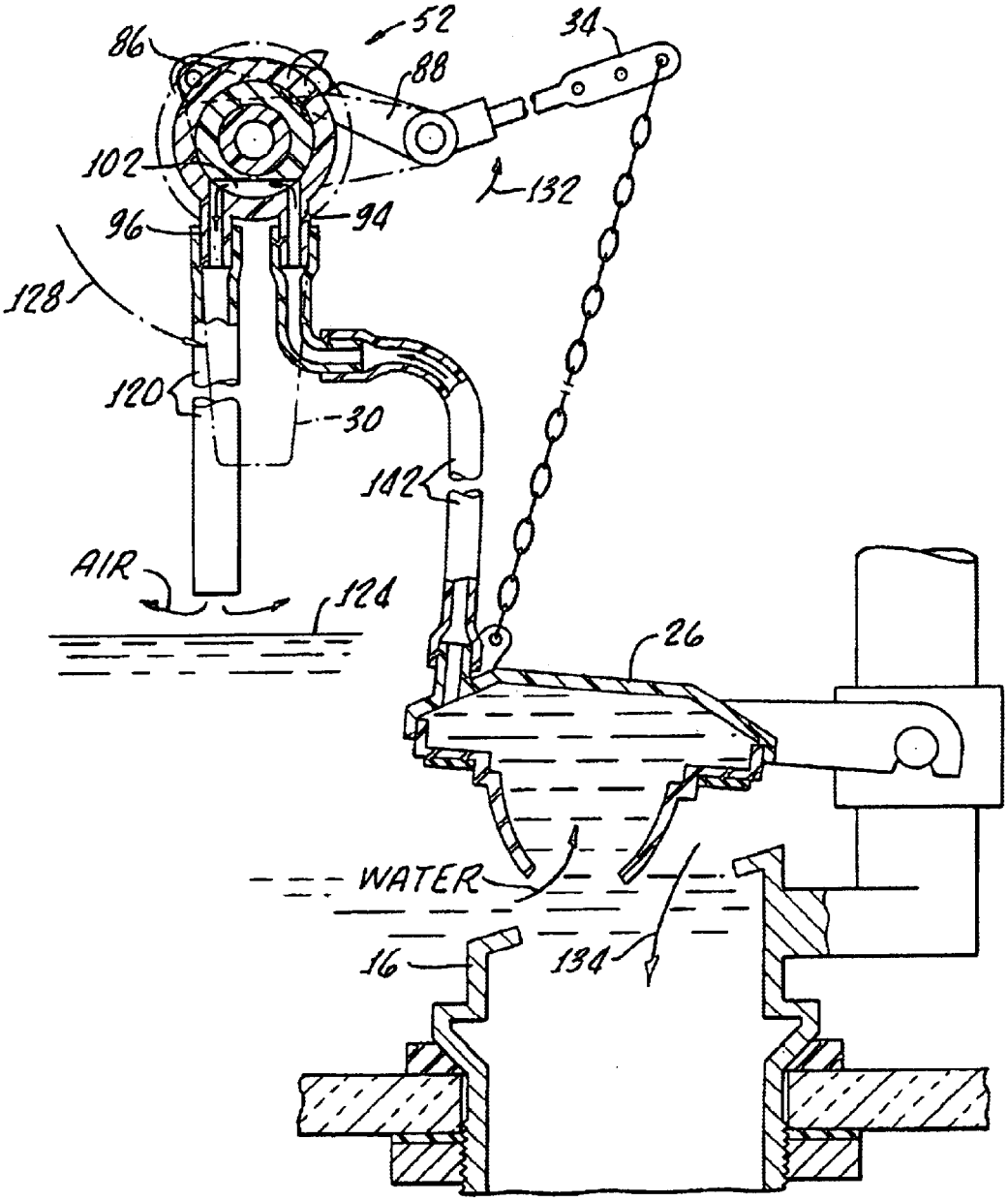
FIG. 3 is similar to FIG. 2 but showing the handle and lever dislodging the flush valve from the discharge port during a partial flush and illustrating early water entry into the flush valve due to venting of air entrapped in the flush valve.

Operation of the dual flush toilet 10 is as follows:

In FIG. 2, the flush valve 26 is shown in the sealed engagement with the discharge port 16 with the handle in a neutral position. The flush valve 26 includes a cavity 130 for entrapping air to cause the flush valve 26 to remain open after unseating of the flush valve from the discharge port 16, as shown in FIGS. 3 and 4.

During partial flush, the handle 30 is pivoted in the direction of the arrow 126 thus lifting the lever 34 as indicated by the arrow 132 causing unseating of the flush valve 26. Initially, the flush valve 26 is buoyant because of the cavity 130 and remains in an unseated position, thus enabling of discharge of water through the discharge port 16 as indicated by the arrow 134.

When the water in the tank 14 drops to the selected level 124, air entrapped in the cavity 130 escapes through the tube the inlet 94 and outlet 96 of the air valve 40 housing 92 and through the depending tube 120. This reduces the buoyancy of the flush valve 26 which then falls under both its own weight and the outflow of water, to reseat against the discharge port 16. As hereinabove discussed, the pneumatic connection allowing this venting of air is provided by alignment of the slot 102 across the inlet 94 and outlet 96 of the rotor body 92.

Accordingly, in a partial flush, the flush valve 26 seals the discharge port 16 when the water in the tank 14 drops below the selected level 124. Since the selected level 124 is above the bottom 138 of the tank, a full flush does not occur, but rather only a partial flush of the water occurs.

Figure 4:
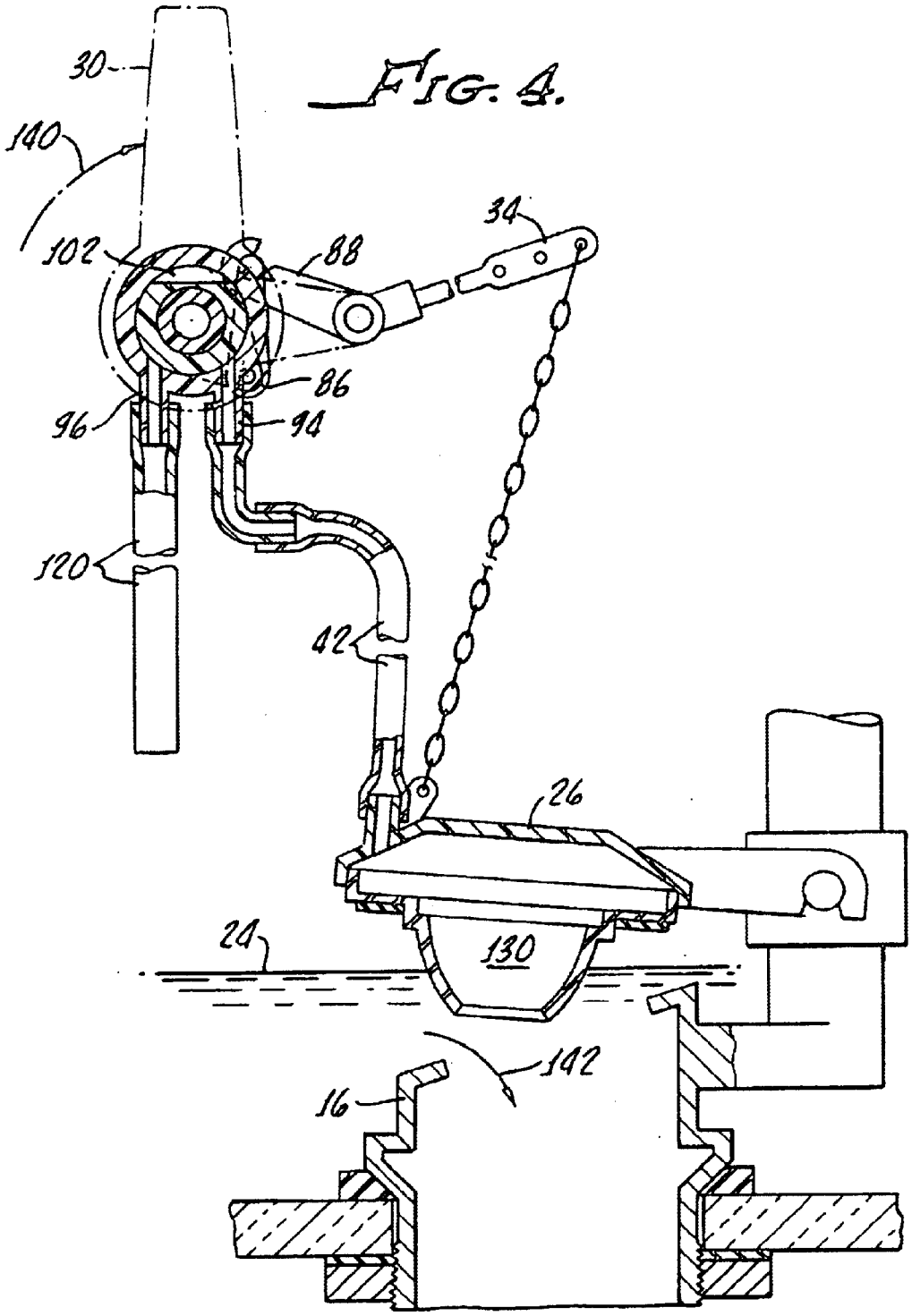
FIG. 4 is a view similar to FIGS. 2 and 3 showing the handle lever unseating the flush valve from the discharge port in a full flush mode which prevents air escape from the flush valve, the flush valve reseating on the discharge port after a full flush of water through the discharge port.

As shown in FIG. 4, when the handle 130 is pivoted in direction of the arrow 140, the level 34 is again raised to unseat the flush valve from the discharge port 16. In this instance however, the slot 102 is not aligned across the air valve body inlet 94 and outlet 96. Accordingly, air is riot vented from the flush valve cavity 30 and the buoyancy of the flush valve keeps it afloat until a full discharge of water through the discharge port occurs. At this point the weight of the flush valve 26 causes a reseating against the discharge port 16 and a seal is again established therebetween.

Thus, it is clear that partial and full flush of the tank is provided by pivoting of the handle 30 in opposite directions which enable an air valve 40 connected to the handle and pneumatically connected to the flush valve 26 for venting entrapped air in the flush valve cavity 130 at a selected water level 124 within the water tank 14.

Although there has been hereinabove described a specific dual flush apparatus in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclose herein. Accordingly, any and all modifications, variations or equivalent arrangements which may occur to those skilled in the art, should be considered to be within the scope of the present invention as defined in the appended claims.

What is claimed is:

1. Dual flush apparatus for a toilet having a water tank with a discharge port for flushing water into a toilet bowl, the apparatus comprising:

a buoyant flush valve for releasably sealing said discharge port and having a cavity for entrapping air to cause the flush valve to remain open after unseating of the flush valve from said discharge port, the flush valve having a weight for causing seating of the flush valve on said discharge port after flushing of water through said discharge port; and a control mechanism configured for mounting to said water tank, said control mechanism comprising:

a handle;

lever means, interconnecting said handle and the flush valve, for unseating the flush valve from said discharge port; and an air valve, connected to said handle and pneumatically connected to the flush valve, for venting entrapped air in the flush valve cavity at a selected water level within said water tank, said air valve comprising:

a body having an inlet and an outlet;

a rotor disposed within said body and including a slot therein for pneumatically connecting the inlet and the outlet upon rotation of said rotor; and a rotor driver for rotating the rotor in order to alternatively align the slot over the inlet and outlet to provide the pneumatic connection and not align the slot over the inlet and outlet to prevent pneumatic connection.

2. The apparatus according to claim 1 wherein said control mechanism further comprises linkage means for enabling the handle to move said lever means in a direction for unseating the flush valve as the handle is pivoted in either of a clockwise direction and a counterclockwise direction.

3. The apparatus according to claim 2 wherein said air valve includes a body with an inlet and an outlet and a rotor disposed within said body and connected to said handle for pneumatically connecting the inlet and outlet as the handle is pivoted in one of the counterclockwise and clockwise directions and preventing pneumatic connection between the inlet and outlet as the handle is pivoted in another of the counterclockwise and clockwise directions.

4. The apparatus according to claim 3 further comprises a flexible tube connected between said inlet and the flush valve.

5. The apparatus according to claim 4 further comprising a depending tube connected to said outlet, said depending tube having a length shorter than a depth of said water tank for enabling escape of air from said outlet as a water level in said water tank falls below the selected level, the selected level being determined by a length of said depending tube.

6. The apparatus according to claim 5 wherein said air valve is disposed between said handle and said linkage means.

7. A dual flush toilet comprising:

a toilet bowl;

a water tank with a discharge port for flushing water into said toilet bowl;

a water valve assembly, including a float, for filling said water tank to a full flush level;

a buoyant flush valve for releasably sealing said discharge port and having a cavity for entrapping air to cause the flush valve to remain open after unseating of the flush valve from said discharge port, the flush valve having a weight for causing sealing of the flush valve on said discharge port after flushing of water through said directing port; and a control mechanism mounted to said water tank, said controlled mounting comprising:

a handle;

lever means, interconnecting said handle and the flush valve, for unseating the flush valve from said discharge port; and an air valve connected to said handle and pneumatically connected to the flush valve, for venting entrapped air in the flush valve cavity at a selected water level within said water tank, said selected water level being less than said full flush level, said air valve comprising:

a body having an inlet and an outlet;

a rotor disposed within said body and including a slot therein for pneumatically connecting the inlet and the outlet upon rotation of said rotor; and a rotor driver for rotating the rotor in order to alternatively align the slot over the inlet and outlet to provide the pneumatic connection and not align the slot over the inlet and outlet to prevent pneumatic connection.

8. The toilet according to claim 7 wherein said control mechanism further comprises linkage means for enabling the handle to move said lever means in a direction for unseating the flush valve as the handle is pivoted in either of a clockwise direction and a counterclockwise direction.

9. The toilet according to claim 8 wherein said air valve includes a body and an inlet and an outlet and a rotor disposed within said body and connected to said handle for pneumatically connecting the inlet and outlet as the handle is pivoted in one of the counterclockwise and clockwise directions and preventing pneumatic connection between the inlet and outlet as the handle is pivoted in another of the counterclockwise and clockwise directions.

10. The toilet according to claim 9 further comprises a flexible tube connected between said inlet and the flush valve.

11. The toilet according to claim 10 further comprising a depending tube connected to said inlet, said depending tube having a length shorter than a depth of said water tank for enabling escape of air from said outlet as a water level in said water tank falls below the selected level, the selected level being determined by a length of said depending tube.

12. The apparatus according to claim 11 wherein said air valve is disposed between said handle and said linkage means.

* * * * *